US011745904B2

(12) United States Patent
Chiang

(10) Patent No.: US 11,745,904 B2
(45) Date of Patent: Sep. 5, 2023

(54) DOUBLE-HEADED TUBE STRUCTURE

(71) Applicant: XIAMEN BONMART MACHINERY AND PLASTIC CO., LTD., Fujian (CN)

(72) Inventor: Chih-Jung Chiang, Xiamen (CN)

(73) Assignee: XIAMEN BONMART MACHINERY AND PLASTIC CO., LTD., Fujian (CN)

( * ) Notice: Subject to any disclaimer, the term of this patent is extended or adjusted under 35 U.S.C. 154(b) by 0 days.

(21) Appl. No.: 17/685,385

(22) Filed: Mar. 3, 2022

(65) Prior Publication Data

US 2022/0219845 A1 Jul. 14, 2022

Related U.S. Application Data

(62) Division of application No. 16/721,921, filed on Dec. 20, 2019, now Pat. No. 11,530,057.

(30) Foreign Application Priority Data

Aug. 16, 2019 (CN) ..... 201910756892.0

(51) Int. Cl.
*B65B 7/28* (2006.01)
*B65D 77/20* (2006.01)
(Continued)

(52) U.S. Cl.
CPC ..... *B65B 7/2842* (2013.01); *B65B 7/2835* (2013.01); *B65D 59/06* (2013.01); *B65D 77/2024* (2013.01); *A45D 34/04* (2013.01)

(58) Field of Classification Search
CPC ..... B29C 43/18; B29C 45/2618; B29C 63/18; B65B 3/022; B65B 7/2835; B65B 7/2842; B65D 25/04
(Continued)

(56) References Cited

U.S. PATENT DOCUMENTS 3,896,710 A * 7/1975 Holoubek ..... B65D 35/02 493/293
8,763,797 B2 * 7/2014 Guillon ..... B65D 81/07 206/204
(Continued)

FOREIGN PATENT DOCUMENTS

WO WO-2017060631 A1 * 4/2017 ..... B05B 11/0013

*Primary Examiner* — Andrew M Tecco
*Assistant Examiner* — Jacob A Smith
(74) *Attorney, Agent, or Firm* — Leong C. Lei

(57) ABSTRACT

A double-headed tube structure comprises a tube body, a first tube head, an annular retaining member and a second tube head. The first tube head and a first end portion of the tube body are hermetically connected together. A second end portion of the tube body is sleeved on an outer circumference of the annular retaining member. The second end portion of the tube body, the annular retaining member and the second tube head are hermetically connected together. The annular retaining member communicates with the tube body and the second tube head. The first and second tube heads are sealedly welded at both ends of the tube body by a two-step forming process. Through the annular retaining member, the tube body is not deformed in the two-step forming process, thereby improving the welding and sealing effect.

11 Claims, 11 Drawing Sheets

(51) Int. Cl.
*B65D 59/06* (2006.01)
*A45D 34/04* (2006.01)

(58) Field of Classification Search
USPC ..... 53/287, 425; 493/293
See application file for complete search history.

(56) References Cited

U.S. PATENT DOCUMENTS

| | | | | |
|---|---|---|---|---|
| 2005/0263430 | A1* | 12/2005 | Giovanni | B65D 83/0409 206/535 |
| 2009/0277912 | A1* | 11/2009 | Wang | B65D 47/2056 220/526 |
| 2014/0183094 | A1* | 7/2014 | Imai | A61J 1/2096 53/432 |
| 2017/0332700 | A1* | 11/2017 | Plews | A24F 42/10 |
| 2019/0112107 | A1* | 4/2019 | Fernández De Mendiola Quintana | B65D 35/14 |

* cited by examiner

DOUBLE-HEADED TUBE STRUCTURE

CROSS REFERENCE TO RELATED APPLICATIONS

This is a divisional application of co-pending patent application Ser. No. 16/721,921, filed on Dec. 20, 2019

BACKGROUND OF THE INVENTION

1. Field of the Invention

The present invention relates to the field of packaging technology, and more particularly to a double-headed tube structure.

2. Description of the Prior Art

Packaging tubes have become one of the main packaging products for cosmetics, medicine and food because they are convenient for use, cost-effective and hygienic. Most cosmetics are packed with packaging tubes, accounting for approximately 60% to 70% of packaging tubes. Packaging tubes used in the pharmaceutical industry for the packaging of creams and ointments for external use account for about 15% to 20%.

In the existing tube structure, the functional head is sealedly welded to the head portion of the tube body. After a substance is filled into the tube body, the tail portion of the tube body is sealed. Therefore, the substance of the existing tube structure is filled one time. After the substance is used up, the tube is abandoned and cannot be reused. In the field of cosmetics and medicine, the manufacturing materials of some special functional heads contain precious metals, and the cost of the precious metals is no less than the substance in the tube, resulting in waste of resources. Besides, the existing tube structure has a single functional head, which cannot satisfy the situation that one substance is in cooperation with different functional heads (for example, eye cream is in cooperation with different types of massage heads). To this end, the manufacturer makes the head portion of the tube body into a connector to cooperate with multiple detachable functional heads. In use, the tube body can only be assembled with one functional head, and the other functional heads are separately stored. It needs to be repeatedly assembled and disassembled for use, which is troublesome. The functional heads that are stored separately are at risk of being lost.

SUMMARY OF THE INVENTION

The primary object of the present invention is to provide a double-headed tube structure. On the premise of the stability of the shape of the tube, tube heads can be sealedly welded at both ends of a tube body, so that the tube body can be matched with different types of tube heads according to the different needs of customers so as to meet the needs of diverse production.

In order to achieve the above object, the present invention adopts the following technical solutions:

A double-headed tube structure comprises a tube body, a first tube head, an annular retaining member and a second tube head. The first tube head and a first end portion of the tube body are hermetically connected together. A second end portion of the tube body is sleeved on an outer circumference of the annular retaining member. The second end portion of the tube body, the annular retaining member and the second tube head are hermetically connected together. The annular retaining member communicates with the tube body and the second tube head.

The first tube head and the first end portion of the tube body are sealedly welded together.

The second end portion of the tube body, the annular retaining member and the second tube head are sealedly welded together.

The annular retaining member has a through hole communicating with the tube body and the second tube head.

The second tube head is formed with an annular flange extending toward the annular retaining member. The annular flange is inserted in the through hole and is restricted from axial movement to prevent the second tube head from being loosened relative to the annular retaining member.

A top end of the annular flange protrudes in a radial direction of the second tube head to form a limiting portion. The through hole is formed with a limiting step corresponding in position to the limiting portion. The limiting portion is mated with the limiting step to prevent the annular flange from coming out of the through hole.

The double-headed tube structure further comprises a first outer cap and a second outer cap. The first outer cap is detachably assembled on the first tube head. The second outer cap is detachably assembled on the second tube head.

An inner circumference of the first outer cap is formed with a first inner engaging portion. An outer circumference of the first tube head is formed with a first outer engaging portion. The first inner engaging portion is matched with the first outer engaging portion so that the first outer cap is movably fitted on the first tube head.

The first inner engaging portion and the first outer engaging portion are screw threads.

An inner circumference of the second outer cap is formed with a second inner engaging portion. An outer circumference of the second tube head is formed with a second outer engaging portion. The second inner engaging portion is matched with the second outer engaging portion so that the second outer cap is movably fitted on the second tube head.

The second inner engaging portion and the second outer engaging portion are screw threads.

Through the above structure, the first tube head and the second tube head of the present invention are sealedly welded at both ends of the tube body respectively by a two-step forming process. When the second tube head is sealedly welded, the end portion of the tube body is not deformed through the annular retaining member to ensure that the tube body is not deformed in the two-step forming process, thereby improving the welding and sealing effect. Different types of tube heads can be sealedly welded at both ends of the tube body according to different needs of customers, meeting the needs of diverse production. Moreover, the structures of the first mold and the second mold are simple, which will not increase additional production cost on the basis of the existing process.

DETAILED DESCRIPTION OF THE PREFERRED EMBODIMENTS

Embodiments of the present invention will now be described, by way of example only, with reference to the accompanying drawings.

Figure 1:
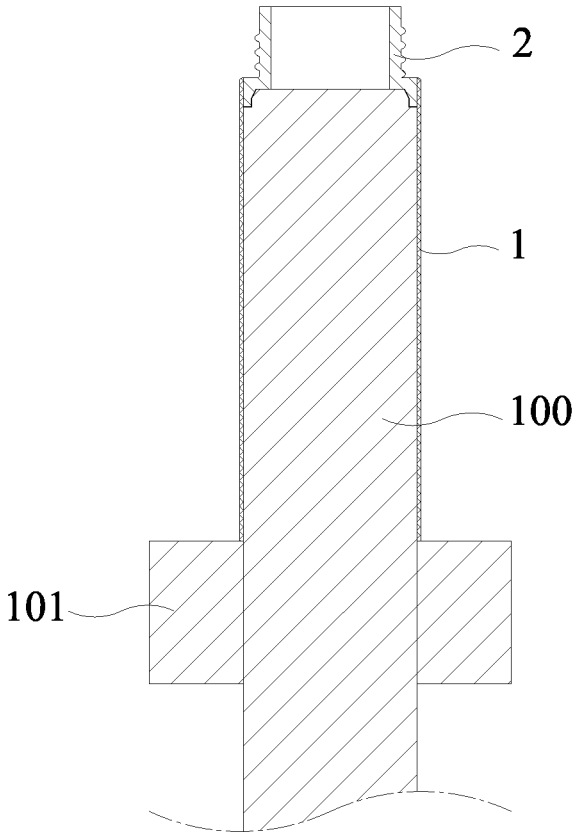
FIG. 1 is a schematic view showing a process of sealedly welding a first tube head in the double-headed tube forming method of the present invention.

A double-headed tube forming method comprises the following steps:

Step 1, as shown in FIG. 1, a tube body 1 is sleeved on a first mold 100, a first tube head 2 is placed at a first end portion of the tube body 1, the peripheries of the first end portion of the tube body 1 and the first tube head 2 are sealedly welded together, and the first mold 100 is removed. Wherein, the outer diameter of the first mold 100 is matched with the inner diameter of the tube body 1 to ensure that the first mold 100 can fully support the tube body 1 so that the tube body 1 is not deformed at the time of welding.

Figure 2:
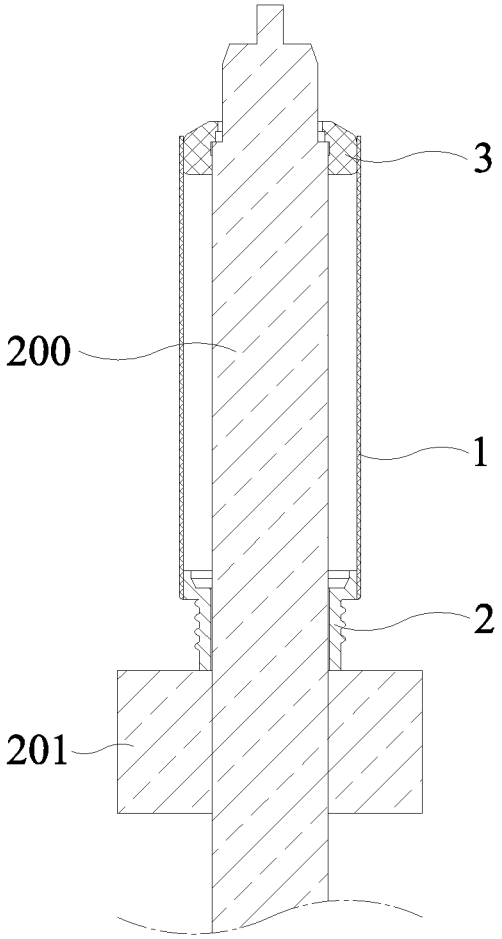
FIG. 2 is a schematic view showing a process of assembling an annular retaining member in the double-headed tube forming method of the present invention.

Step 2, as shown in FIG. 2, a second mold 200 is inserted through an opening of the first tube head 2 to a second end portion of the tube body 1, and an annular retaining member 3 is fitted on one end portion of the second mold 200 and located inside the second end portion of the tube body 1. Wherein, the outer diameter of the annular retaining member 3 is matched with the inner diameter of the tube body 1 to ensure that the annular retaining member 3 can fully support the second end portion of the tube body 1 so that the tube body 1 is not deformed in the subsequent welding process. The inner diameter of the annular retaining member 3 is matched with the outer diameter of the second mold 200 to ensure that the annular retaining member 3 is confined and fitted at the end portion of the second mold 200.

Figure 3:
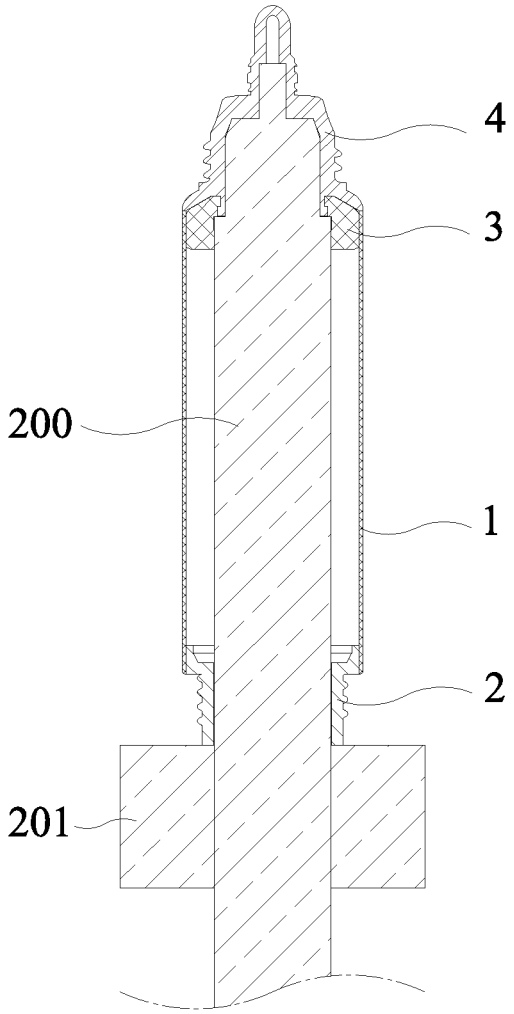
FIG. 3 is a schematic view showing a process of sealedly welding a second tube head in the double-headed tube forming method of the present invention.

Step 3, referring to FIG. 3, a second tube head 4 is placed at the second end portion of the tube body 1, the peripheries of the second end portion of the tube body 1, the annular retaining member 3 and the second tube head 4 are sealedly welded together, and the second mold 200 is removed.

The first tube head 2 and the second tube head 4 may be a functional head or a connector for connecting a functional head or a screw cap according to production requirements. That is, the functional head of the final product may be directly formed on the tube body 1, not detachable, or may be detachably mounted on the tube body 1 through a connector. As shown in FIGS. 1 to 3, the first tube head 2 is a connector having a large-diameter nozzle in cooperation with a screw cap for filling a substance repeatedly. The second tube head 4 is an extrusion-type functional head having a small-diameter nozzle for extruding the substance.

Referring to FIGS. 1 to 3, the first mold 100 and the second mold 200 are cylindrical molds. The first mold 100 and the second mold 200 are respectively provided with a first limiting disc 101 and a second limiting disc 201 that are adjustable for limiting the position of the first mold 100 or the second mold 200 to be inserted into the tube body 1. In addition, the position of the first limiting disc 101 and the second limiting disc 201 can be adjusted according to the size of the tube body 1. The cylindrical mold has a circular, elliptical or regular polygonal cross-section for different types of tube bodies 1.

Through the above method, the first tube head 2 and the second tube head 4 of the present invention are sealedly welded at both ends of the tube body 1 respectively by a two-step forming process. When the second tube head 4 is sealedly welded, the end portion of the tube body 1 is not deformed through the annular retaining member 3 to ensure that the tube body 1 is not deformed in the two-step forming process, thereby improving the welding and sealing effect. Different types of tube heads can be sealedly welded at both ends of the tube body 1 according to different needs of customers, meeting the needs of diverse production. Moreover, the structures of the first mold 100 and the second mold 200 are simple, which will not increase additional production cost on the basis of the existing process.

Referring to FIGS. 4 to 11, a double-headed tube structure comprises a tube body 1, a first tube head 2, an annular retaining member 3, and a second tube head 4. The first tube head 2 is hermetically connected to a first end portion of the tube body 1. A second end portion of the tube body 1 is sleeved on the outer circumference of the annular retaining member 3. The second end portion of the tube body 1, the annular retaining member 3 and the second tube head 4 are hermetically connected together. The annular retaining member 3 has a through hole 31 communicating with the tube body 1 and the second tube head 4. The above hermetical connection can be achieved by sealedly welding.

The first tube head 2 and the second tube head 4 may be a functional head or a connector for connecting a functional head or a screw cap according to production requirements.

The second tube head 4 is formed with an annular flange 41 extending toward the annular retaining member 3. The annular flange 41 is inserted in the through hole 31 and is restricted from axial movement to prevent the second tube head 4 from being loosened relative to the annular retaining member 3.

The top end of the annular flange 41 protrudes in the radial direction of the second tube head 4 to form a limiting portion 42. The through hole 31 is formed with a limiting step 32 corresponding in position to the limiting portion 42. The limiting portion 42 is mated with the limiting step 32 to prevent the annular flange 41 from coining out of the through hole 31, thereby improving the structural stability of the second tube head 4 and the annular retaining member 3.

The double-headed tube structure further comprises a first outer cap 5 and a second outer cap 6. The first outer cap 5 is detachably assembled on the outer circumference of the first tube head 2. The second outer cap 6 is movably sleeved on the outer circumference of the second tube head 4. The specific structure refers to the first, second and third embodiments of the present invention. The outer circumference of the first tube head 2 is formed with a first outer engaging portion 21. The inner side of the first outer cap 5 is formed with a first inner engaging portion 51. The first inner engaging portion 51 is matched with the first outer engaging portion 21 so that the first outer cap 5 is detachably mounted on the first tube head 2. The outer circumference of the second tube head 4 is formed with a second outer engaging portion 43. The inner side of the second outer cap 6 is formed with a second inner engaging portion 61. The second inner engaging portion 61 is matched with the second outer engaging portion 43 so that the second outer cap 6 is detachably mounted on the second tube head 4. In the above embodiment, the first outer engaging portion 21, the first inner engaging portion 51, the second outer engaging portion 43 and the second inner engaging portion 61 are all screw threads, and the corresponding tube body 1 has a cylindrical shape. Referring to the fourth and fifth embodiments of the present invention, the second outer cap 6 and the second tube head 4 are engaged by a snap fit, and the corresponding tube body 1 has an elliptical or other non-cylindrical shape. Of course, the manner of snap fit is also adapted for the cylindrical tube body 1.

Figure 4:
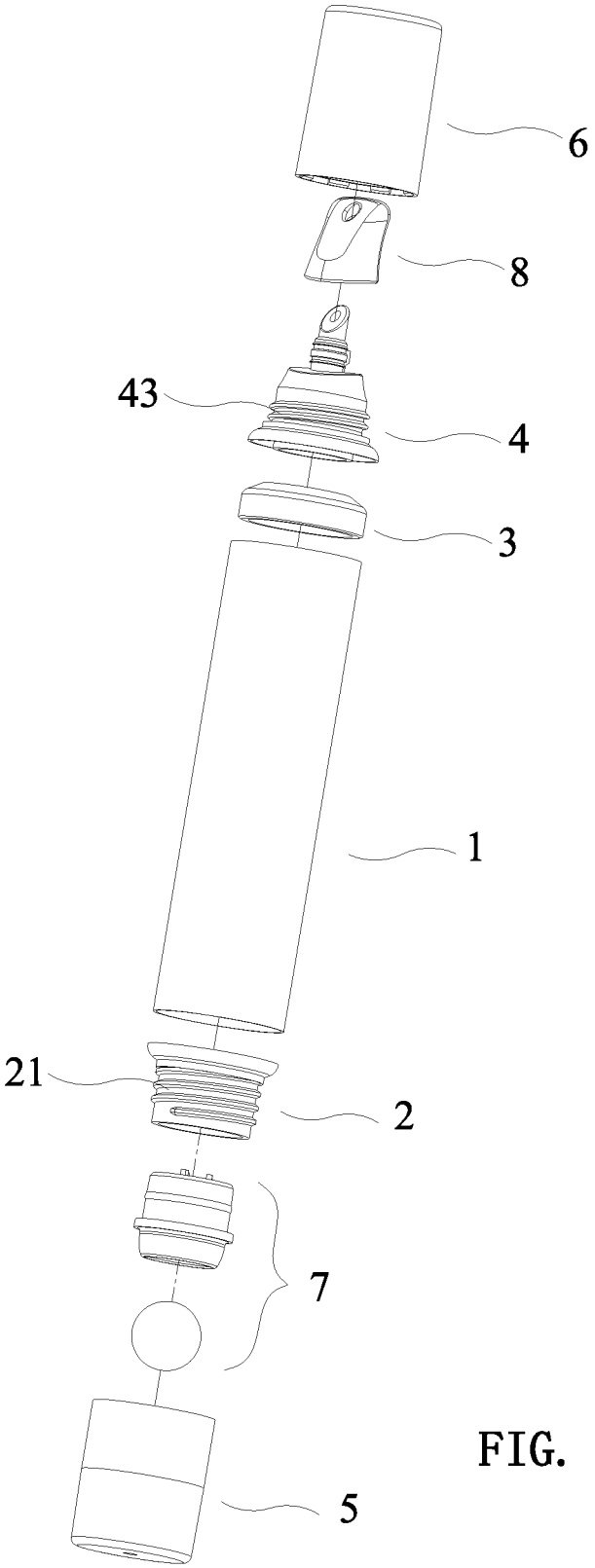
FIG. 4 is an exploded view of the double-headed tube structure in accordance with a first embodiment of the present invention.
Figure 5:
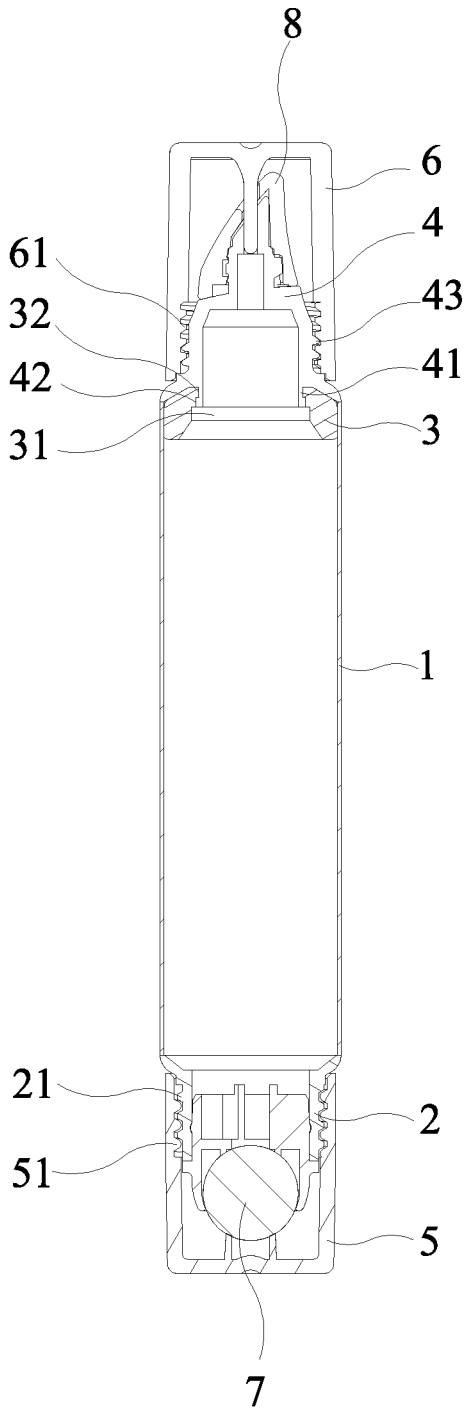
FIG. 5 is a cross-sectional view of the double-headed tube structure in accordance with the first embodiment of the present invention.

Referring to FIG. 4 and FIG. 5, in the first embodiment of the present invention, the first tube head 2 is a connector, and a rolling ball massage head 7 is assembled in the opening of the first tube head 2 to complete the non-detachable fitting, that is, the first tube head 2 is set as a functional head. The second tube head 4 is an extrusion-type functional head having a small-diameter nozzle. The outer end of the nozzle is equipped with a metal massage head 8. The first embodiment can realize the requirement that a substance is in cooperation with two functional heads. However, since both ends of the tube body 1 are not detachable, it is impossible to refill the substance after use.

Figure 6:
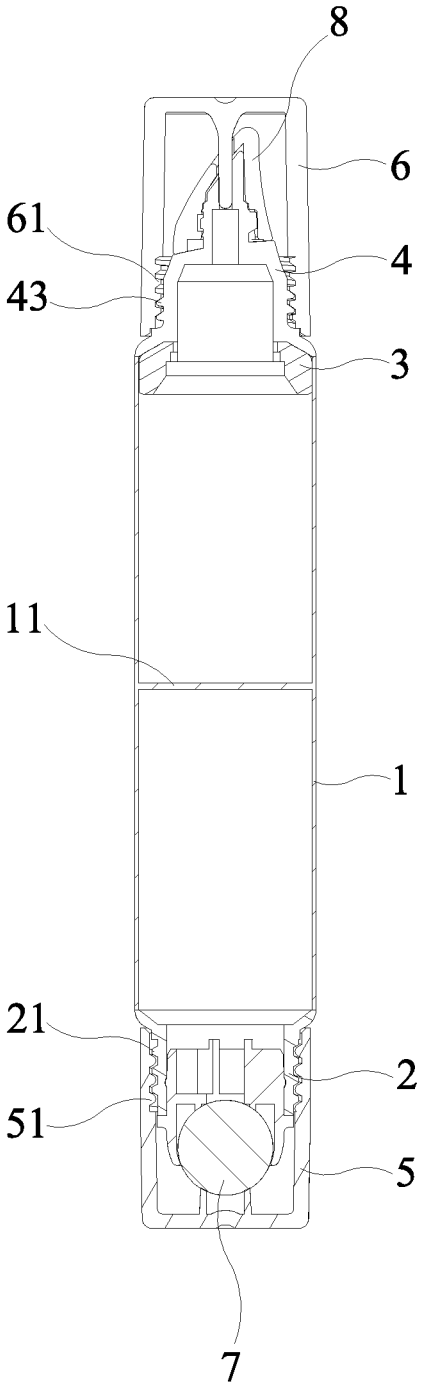
FIG. 6 is a cross-sectional view of the double-headed tube structure in accordance with a second embodiment of the present invention.

FIG. 6 illustrates a second embodiment of the present invention, which is substantially similar to the first embodiment with the exceptions described hereinafter. A partition portion 11 is formed inside the tube body 1. The partition portion 11 divides the cavity of the tube body 1 into two. Thus, two same or different substances can be separately filled into one tube body 1 corresponding to different types of functional heads, so as to meet the diverse needs of customers.

Figure 7:
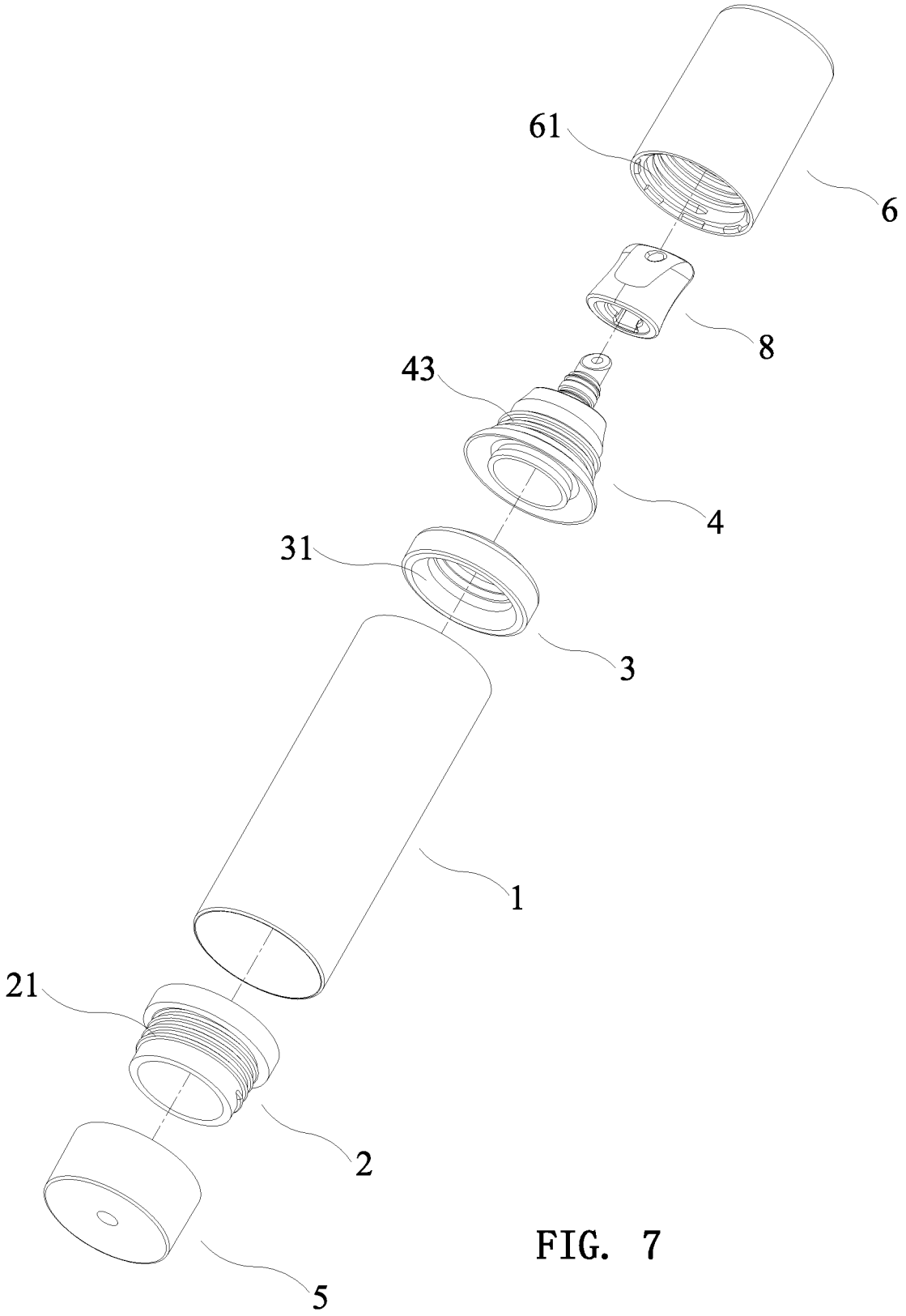
FIG. 7 is an exploded view of the double-headed tube structure in accordance with a third embodiment of the present invention.
Figure 8:
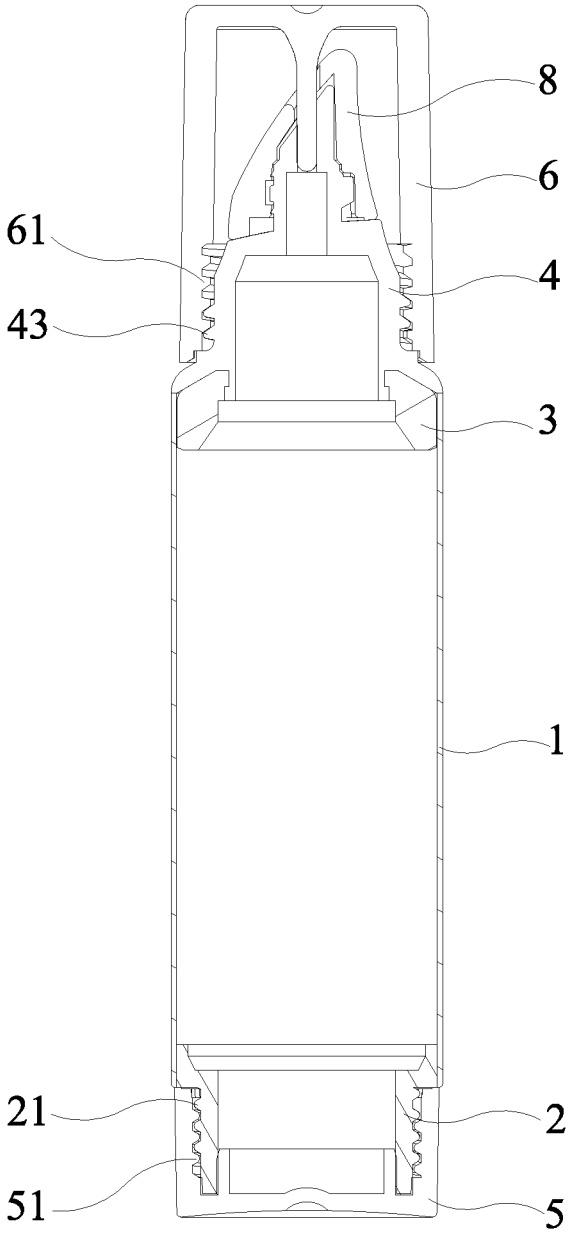
FIG. 8 is a cross-sectional view of the double-headed tube structure in accordance with the third embodiment of the present invention.

FIG. 7 and FIG. 8 illustrate a third embodiment of the present invention. The first tube head 2 is a connector. The first outer cap 5 in cooperation with the first tube head 2 is a screw cap. The second tube head 4 is an extrusion-type functional head having a small-diameter nozzle. The outer end of the nozzle is equipped with a metal massage head 8. In the third embodiment, the substance is used in cooperation with only one functional head, but the substance can be filled repeatedly by unscrewing the first outer cap 5.

Figure 9:
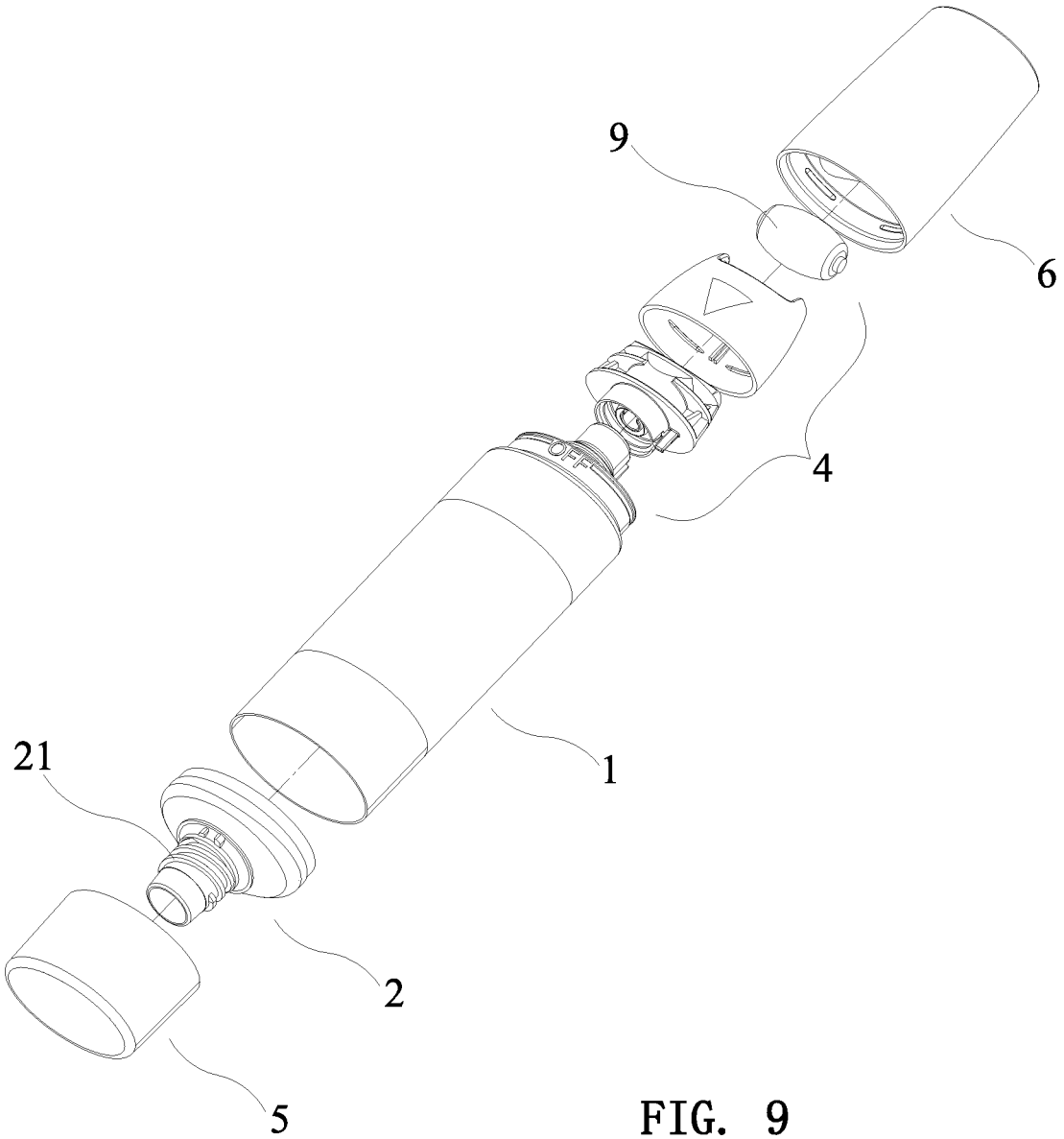
FIG. 9 is an exploded view of the double-headed tube structure in accordance with a fourth embodiment of the present invention.
Figure 10:
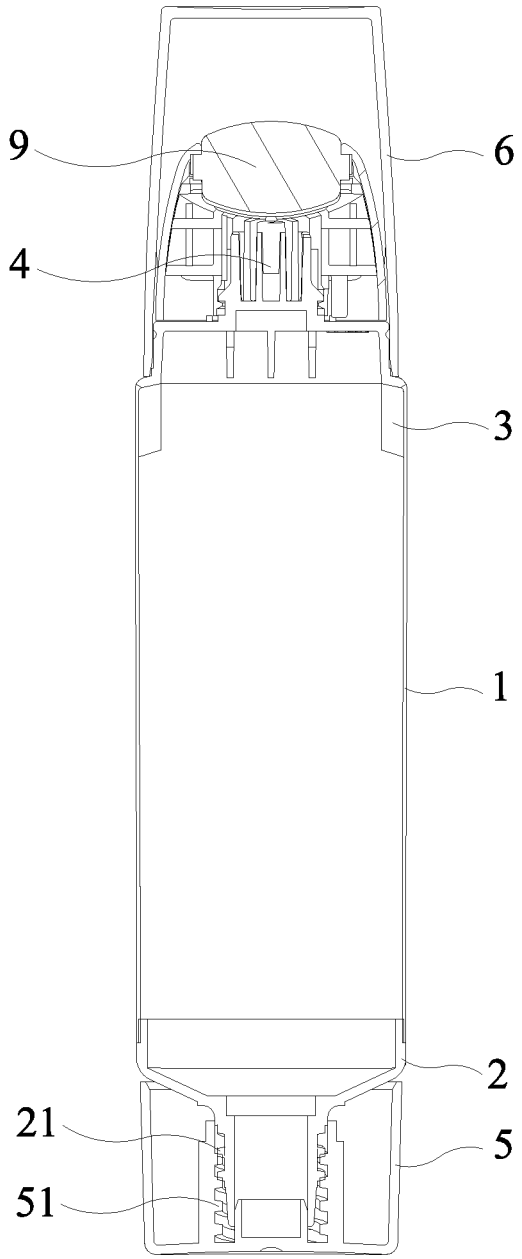
FIG. 10 is a cross-sectional view of the double-headed tube structure in accordance with the fourth embodiment of the present invention.

FIG. 9 and FIG. 10 illustrate a fourth embodiment of the present invention. The first tube head 2 is a connector. The first outer cap 5 in cooperation with the first tube head 2 is a screw cap. The second tube head 4 is a roller massage head having a roller 9. Similarly, in the fourth embodiment, the substance is used in cooperation with only one functional head, but the substance can be filled repeatedly by unscrewing the first outer cap 5.

Figure 11:
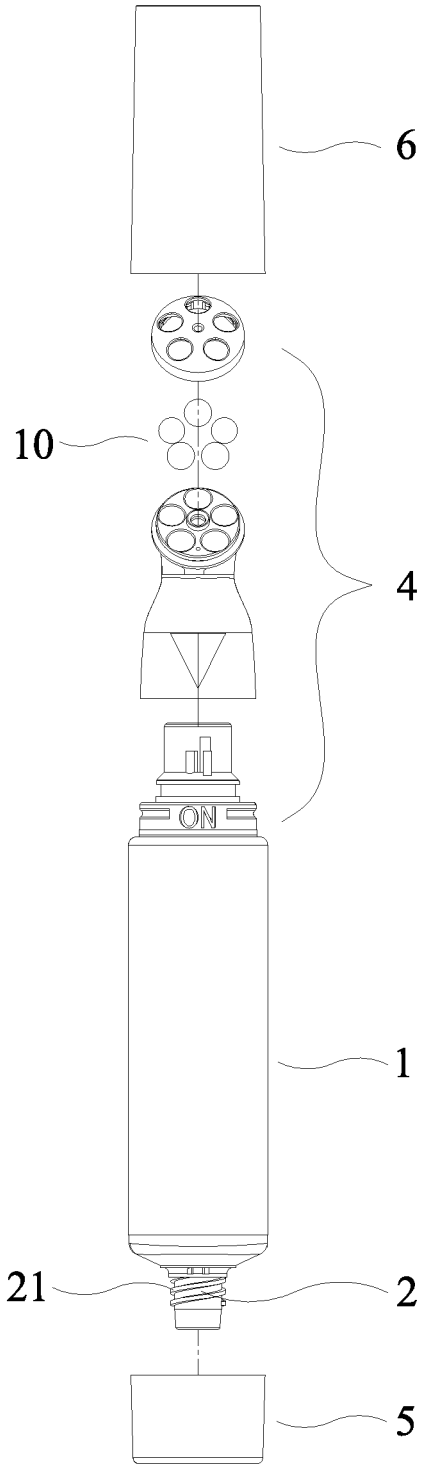
FIG. 11 is an exploded view of the double-headed tube structure in accordance with a fifth embodiment of the present invention.

FIG. 11 illustrates a fifth embodiment of the present invention. The first tube head 2 is a connector. The first outer cap 5 in cooperation with the first tube head 2 is a screw cap. The second tube head 4 is a rolling ball massage head having a plurality of balls 10. Similarly, in the fifth embodiment, the substance is used in cooperation with only one functional head, but the substance can be filled repeatedly by unscrewing the first outer cap 5.

In addition to the above embodiments, the functional head may be a functional head suitable for cosmetics and medicine, such as a comb-type functional head, a brush-type functional head or a pellet-type massage functional head. The functional head facilitates the use of the substance in the tube body 1 by applying, spreading, or the like.

Through the above structure, the present invention provides the annular retaining member 3 at the welding position of the second tube head 4 and the tube body 1. The tube body 1 is supported by the annular retaining member 3 to maintain the shape of the tub body 1, thereby ensuring the welding and sealing effect. In production, the first tube head 2 and the second tube head 4 are sealedly welded at both ends of the tube body 1 by a two-step forming process under the premise that the shape of the tube body 1 is not deformed, so that different types of tube heads can be assembled according to the needs of customer, meeting the needs of diverse production.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A double-headed tube structure, comprising a tube body, a first tube head, an annular retaining member and a second tube head; the first tube head and a first end portion of the tube body being hermetically connected together in a fixed and immovable manner, a second end portion of the tube body being sleeved on an outer circumference of the annular retaining member, the second end portion of the tube body, the annular retaining member and the second tube head being hermetically connected together in a fixed and immovable manner; the annular retaining member communicating with the tube body and the second tube head, wherein the tube has a hollow interior adapted to receive a substance therein, and each of the first tube head and the second tube head comprises a structure of access to the hollow interior of the tube, the structure of access forming a passage for the substance in and out of the hollow interior of the tube.

2. The double-headed tube structure as claimed in claim 1, wherein the first tube head and the first end portion of the tube body are sealedly welded together.

3. The double-headed tube structure as claimed in claim 1, wherein the second end portion of the tube body, the annular retaining member and the second tube head are sealedly welded together.

4. The double-headed tube structure as claimed in claim 1, wherein the annular retaining member has a through hole communicating with the tube body and the second tube head.

5. The double-headed tube structure as claimed in claim 4, wherein the second tube head is formed with an annular flange extending toward the annular retaining member, the annular flange is inserted in the through hole and is restricted from axial movement to prevent the second tube head from being loosened relative to the annular retaining member.

6. The double-headed tube structure as claimed in claim 5, wherein a top end of the annular flange protrudes in a radial direction of the second tube head to form a limiting portion, the through hole is formed with a limiting step corresponding in position to the limiting portion, and the limiting portion is mated with the limiting step to prevent the annular flange from coining out of the through hole.

7. The double-headed tube structure as claimed in claim 1, further comprising a first outer cap and a second outer cap, the first outer cap being detachably assembled on the first tube head, the second outer cap being detachably assembled on the second tube head.

8. The double-headed tube structure as claimed in claim 7, wherein an inner circumference of the first outer cap is formed with a first inner engaging portion, an outer circumference of the first tube head is formed with a first outer engaging portion, the first inner engaging portion is matched with the first outer engaging portion so that the first outer cap is movably fitted on the first tube head.

9. The double-headed tube structure as claimed in claim 8, wherein the first inner engaging portion and the first outer engaging portion are screw threads.

10. The double-headed tube structure as claimed in claim 7, wherein an inner circumference of the second outer cap is formed with a second inner engaging portion, an outer circumference of the second tube head is formed with a second outer engaging portion, the second inner engaging portion is matched with the second outer engaging portion so that the second outer cap is movably fitted on the second tube head.

11. The double-headed tube structure as claimed in claim 10, wherein the second inner engaging portion and the second outer engaging portion are screw threads.

* * * * *